US012082668B2

(12) United States Patent
Schreibstein et al.

(10) Patent No.: US 12,082,668 B2
(45) Date of Patent: Sep. 10, 2024

(54) APPARATUS, SYSTEM, AND METHOD FOR PROTECTING EYEGLASSES

(71) Applicants: Steven Schreibstein, Newburgh, NY (US); Richard Rainier Lierow, Warwick, NY (US)

(72) Inventors: Steven Schreibstein, Newburgh, NY (US); Richard Rainier Lierow, Warwick, NY (US)

( * ) Notice: Subject to any disclaimer, the term of this patent is extended or adjusted under 35 U.S.C. 154(b) by 0 days.

(21) Appl. No.: 17/658,264

(22) Filed: Apr. 7, 2022

(65) Prior Publication Data

US 2022/0322799 A1 Oct. 13, 2022

Related U.S. Application Data

(60) Provisional application No. 63/171,973, filed on Apr. 7, 2021.

(51) Int. Cl.

| | |
|---|---|
| ***A45C 11/04*** | (2006.01) |
| ***A45C 13/02*** | (2006.01) |
| ***A45C 13/10*** | (2006.01) |
| ***A45F 5/02*** | (2006.01) |
| ***B65D 21/08*** | (2006.01) |

(52) U.S. Cl.

CPC ..... *A45C 11/04* (2013.01); *A45C 13/02* (2013.01); *A45C 13/10* (2013.01); *A45F 5/021* (2013.01); *B65D 21/086* (2013.01); *A45C 2013/026* (2013.01); *A45C 2013/1015* (2013.01); *A45F 2200/0541* (2013.01)

(58) Field of Classification Search

CPC ..... A45C 11/04; A45C 13/02; A45C 13/10; A45C 2013/026; A45C 2013/1015; A45F 5/021; A45F 2200/0541; B65D 21/086

USPC ..... 206/5

See application file for complete search history.

(56) References Cited

U.S. PATENT DOCUMENTS

| | | | | | |
|---|---|---|---|---|---|
| 4,057,166 | A * | 11/1977 | Yamazaki | B60N 3/083 | 220/8 |
| 5,513,744 | A * | 5/1996 | Yabarra | A45C 11/04 | 206/5 |
| 5,626,224 | A * | 5/1997 | Clark | A45C 11/04 | 206/5 |
| 5,791,460 | A * | 8/1998 | Fitzgerald | B60R 7/082 | 224/544 |
| 6,279,804 | B1 * | 8/2001 | Gregg | A45F 5/02 | 224/675 |
| 11,432,634 | B2 * | 9/2022 | Silva | A45D 40/18 | |
| 2004/0089703 | A1 * | 5/2004 | Gosis | B65D 21/086 | 229/122.32 |
| 2017/0202324 | A1 * | 7/2017 | Van Geer | A45C 1/06 | |

* cited by examiner

*Primary Examiner* — Robert J Hicks
*Assistant Examiner* — Sanjidul Islam
(74) *Attorney, Agent, or Firm* — Dunlap Bennett & Ludwig, PLLC

(57) ABSTRACT

A rugged eyeglass case is herein disclosed. The case is belt-mounted with an open mouth and includes removable inserts for the accommodation of all sizes of sunglasses. The case holds glasses firmly, even when inverted, due to a unique design that includes a locking pad positioned on the interior of the case. The present invention enables single-handed extraction and insertion of the glasses and retention of the glasses under rough, often violent, outdoor circumstances.

8 Claims, 5 Drawing Sheets

APPARATUS, SYSTEM, AND METHOD FOR PROTECTING EYEGLASSES

CROSS-REFERENCE TO RELATED APPLICATION

This application claims the benefit of priority of U.S. provisional application No. 63/171,973, filed Apr. 7, 2021, the contents of which are herein incorporated by reference.

BACKGROUND OF THE INVENTION

The present invention relates to eyeglass cases and, more particularly, to a belt worn, open-mouth eyeglass case with a hook and loop fastener belt-attaching flap and a unique internal mechanism for retaining and protecting the eyewear under the most strenuous conditions.

Eyeglasses, such as prescription glasses and non-prescription sunglasses, are expensive, typically costing hundreds of dollars, if not more. Active people, such as, but not limited to, police, military, motorcycle and bicycle riders, golfers, beachgoers, horsemen, boaters, runners and joggers have no way to safely and securely carry eyewear when they remove them for darkness, weather or other reasons. These expensive glasses are commonly lost or broken by active people.

Thousands of eyeglass cases are made for decorative or pocketbook use. Every other case employs some type of snap, flap, hook and loop fastener, magnet or other external covers to secure the eyeglasses within the case. However, none are belt-mounted for uniformed, combat service, strenuous or high-speed recreational wear or hunting or fishing, climbing or running. Further, none of these cases restrain the glasses internally.

There is a long-felt need by the aforementioned groups of individuals, as well as others (e.g., construction workers) who are often exposed to conditions where impact to the eyeglass case is a possibility. These individuals need to be able to put on or remove glasses from the case with one hand and need to be able to wear the case under rough, often violent, outdoor circumstances. By way of example, suppose a police officer or a soldier has a gun in one hand or is operating a vehicle at high speed with one hand. In either scenario, it is impossible to manipulate an eyewear case that requires two hands to open and remove the glasses. There is currently no product available to address these shortcomings.

As can be seen, there is a need for a semi-rigid, rugged, open-mouth eyeglass case that can attach to the body of a user, as described herein. The present invention is specifically configured to withstand high impacts, making it appropriate for police and military use. It is belt-mounted, defines an open mouth upper end, and includes removable inserts for the accommodation of all sizes of sunglasses. The present invention holds glasses firmly even when inverted due to an interior locking pad. Further details of the present invention are provided in the following disclosure.

SUMMARY OF THE INVENTION

In one aspect of the present invention, an eyeglass case for eyeglasses comprises: a flexible outer case defining a substantially closed end and an open end; a first rigid insert shaped to removably fit within the flexible outer case; and a locking pad coupled to the first rigid insert, the locking pad being configured to deform when the eyeglasses are inserted, through the open end, into the outer case.

In another aspect of the present invention, an eyeglass protection system comprises: eyeglasses; and an eyeglass case comprising: a flexible outer case defining a substantially closed end and an open end; a first rigid insert shaped to removably fit within the flexible outer case; and a locking pad coupled to the first rigid insert, the locking pad being configured to deform when the eyeglasses are inserted, through the open end, into the outer case.

The open-mouthed case of the present invention cannot be dislodged from a belt or strap to which it is attached. The glasses cannot be ejected even if inverted, in combat, on a bucking bronco, or inverted underwater. Still, it has an open design such that the eyewear can be extracted with two fingers of one hand in an instant. In certain embodiments, the case is configured such that it weighs a maximum of 2.5 ounces with both inserts in place, and is very light, inexpensive, and unobtrusive on the wearer. In certain embodiments, the case, without inserts, may weigh less than an ounce. The average pair of eyeglasses weighs between 1.4 ounces and 1.75 ounces. Consequently, with both inserts in place and loaded with a pair of glasses, the total weight may be approximately 4 ounces. At such a minimal weight, the wearer won't even notice the case is there (except for when the wearer is performing the act of storing or retrieving the glasses).

The claimed invention differs from what currently exists. Even the U.S. military does not issue a case that solves the problem of single-handed extraction and insertion of eyewear, which is vital when there is a gun in the other hand, or on the steering wheel of a speeding vehicle or boat navigating choppy waters. No open-mouthed case exists that can hold eyewear securely under violent and gross body movement.

No eyeglass case currently produced attaches secured to a duty belt or pants belt under these aforementioned extreme conditions. They also do not hold the glasses securely unless they are embodied as closed boxes, which are not usable at all while engaged in vigorous action.

As described above, motorcycle riders, bicyclists, cowboys, golfers, construction workers, police officers, and other eyeglass wearers very often need to be able to put on or remove glasses from a case with a single hand, and need to wear the case under rough, often violent, outdoor circumstances. The present invention is the only eyeglass case in existence that effectively addresses these specific problems encountered by millions of individuals.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
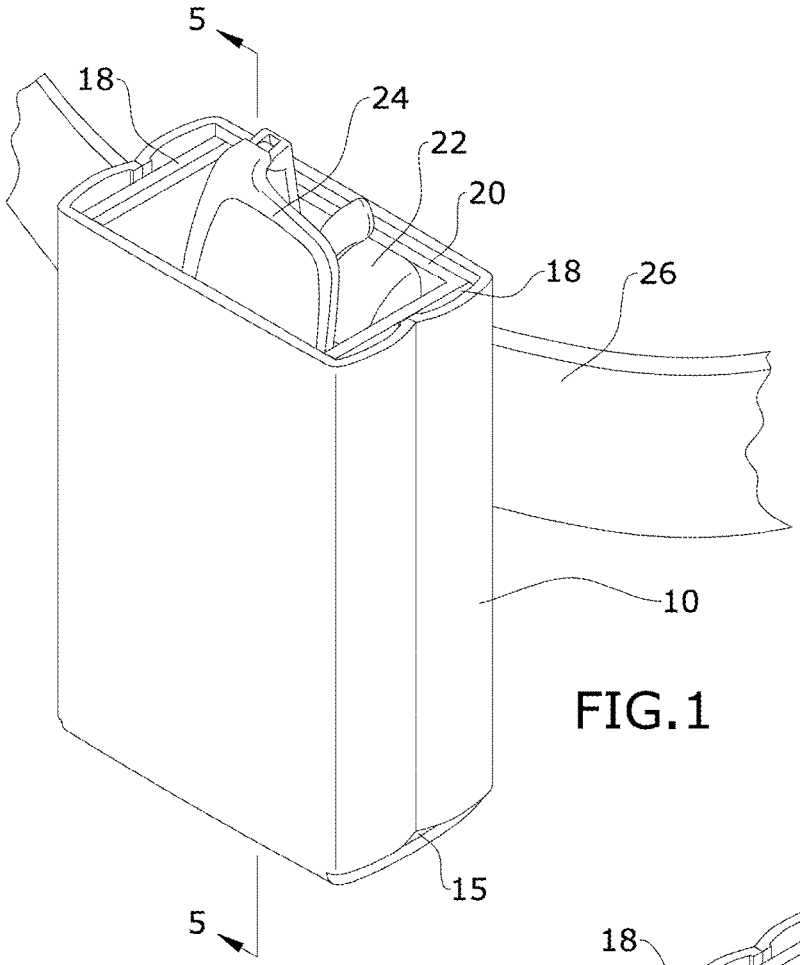
FIG. 1 is a perspective view of an embodiment of the present invention, shown in use with eyeglasses and coupled to a belt.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details. For the purpose of clarity, technical material that is known in the technical fields related to the present invention has not been described in detail so that the present invention is not unnecessarily obscured.

As used herein the terms "eyeglass", "eyeglasses" and "glasses" is intended to encompass prescription glasses, non-prescription sunglasses, and the like (e.g., prescription sunglasses and reading glasses).

The present invention is advantageously open at an upper end thereof and wearable on a user's belt. It has an internal device that prevents the glasses from falling out under any circumstance, and yet the glasses can be inserted and extracted easily and swiftly with two fingers on one hand, no matter how fast the user is moving. Embodiments of the present invention include no metal, no moving parts, no latches, and no covering flap and are lightweight, weighing approximately 2 ounces. There is nothing remotely similar in size, weight, retention of eyewear and portability, flexibility, and dependability.

The present invention is utterly stationary on the belt or strap to which it is affixed. The internal locking pad prevents glasses of any size from being ejected under the most strenuous circumstances (even activity as extreme as bull-riding at a rodeo, for instance). An incredibly diverse range of users, such as pilots, golfers, skateboarders, and the elderly (who may easily misplace their glasses), will benefit from the present invention, which permits the dependable, secure, body-worn carrying of glasses.

Figure 2:
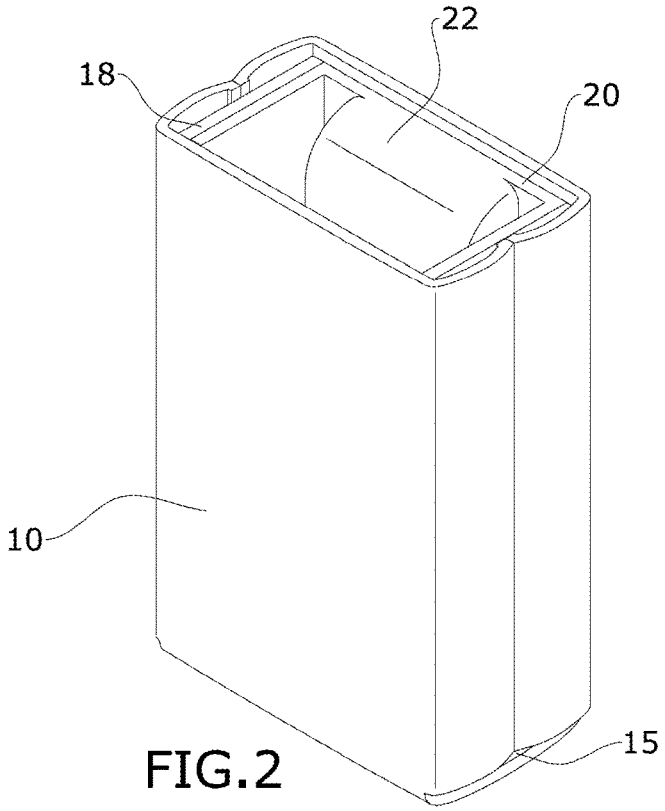
FIG. 2 is a front perspective view of the embodiment of the present invention.

Referring now to FIGS. 1-11, a rugged eyeglass case is generally shown in FIG. 2. The eyeglass case generally includes a flexible outer case 10, a flap 12, a pair of hard removable inserts 18, 20, and a locking pad 22.

Figure 5:
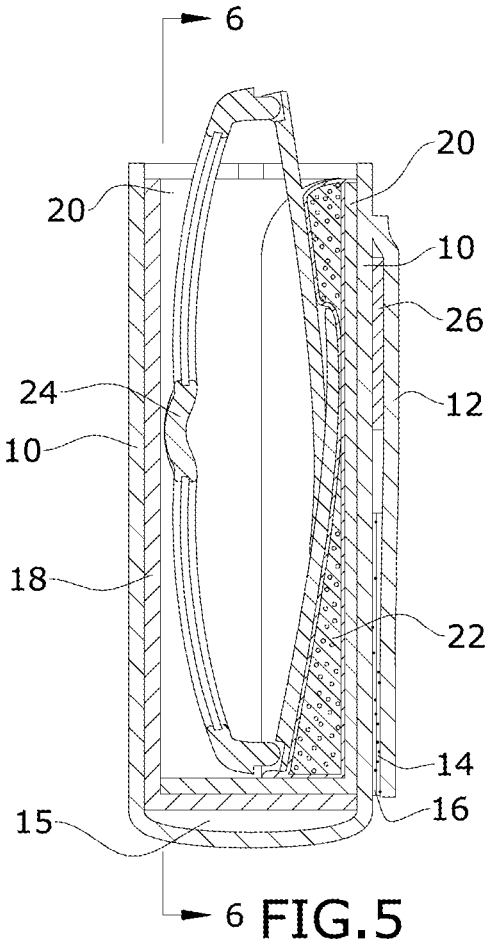
FIG. 5 is a section view of the embodiment of the present invention, taken along line 5-5 in FIG. 1.
Figure 6:
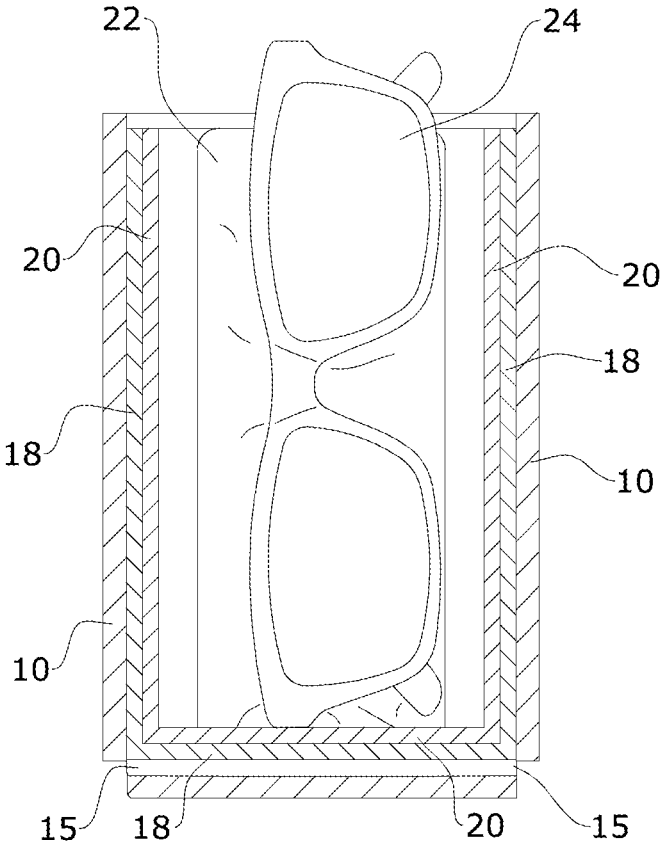
FIG. 6 is a section view of the invention, taken along line 6-6 in FIG. 5 with glasses 24 shown in full for clarity.

The flexible outer case 10 is provided with a substantially closed side (e.g., see bottom of FIG. 5) and an open mouth side (e.g., see top of FIG. 5). Further, it may include a microfiber lining. The outer case 10 is flexible such that it may receive various sizes and shapes of eyewear 24.

Figure 7:
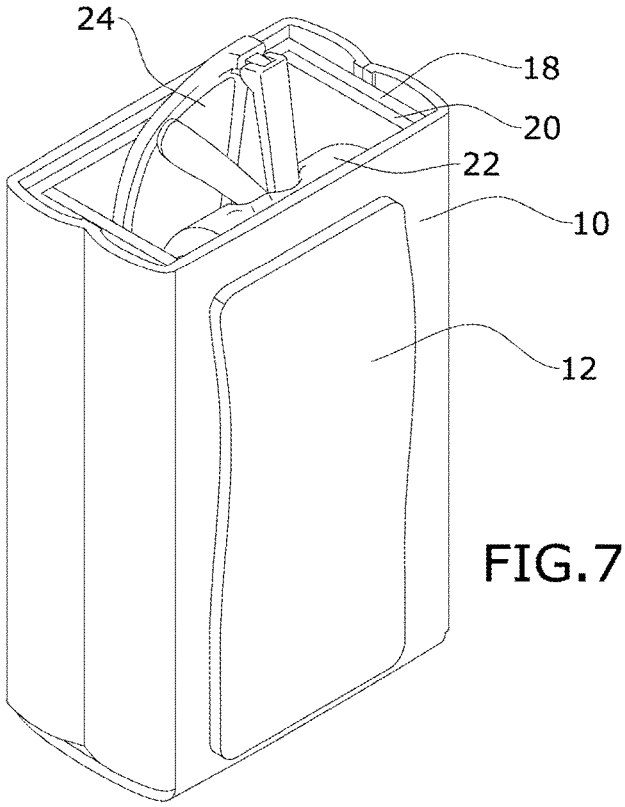
FIG. 7 is a rear perspective view of the embodiment of the present invention, shown in use with eyeglasses.
Figure 8:
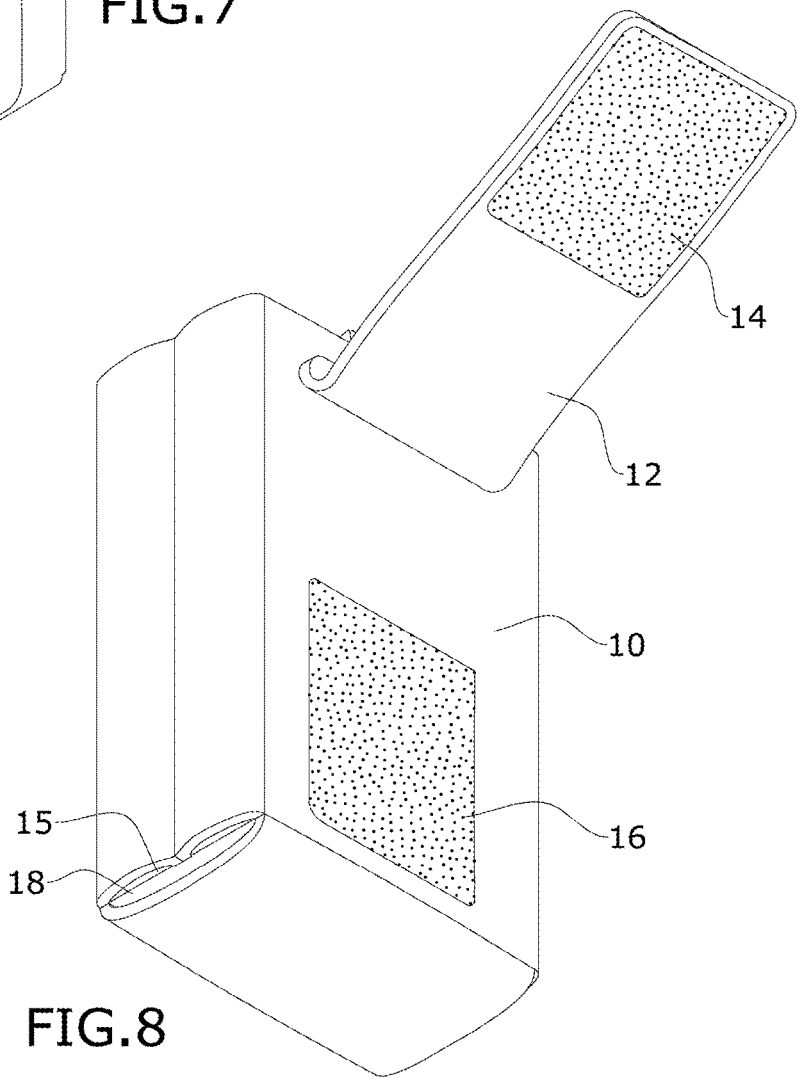
FIG. 8 is a bottom perspective view of the embodiment of the present invention, shown with a belt mounting flap pulled away from the remainder of the embodiment.

As shown in FIGS. 7 and 8, the flap 12 is coupled to a rear side of the outer case 10. The flap 12 includes a loop fastener portion 14 that couples with a complementary hook fastener portion 16 on the rear side of the outer case 10. The design enables the rugged eyeglass case to secure to various size belts. For example, it may couple to belts ranging in size from 0.75 inches to 2.75 inches wide. It will be appreciated that, of course, the flap 12 may be used to couple to items other than a belt 26 such as, but not limited to, backpack straps, suspenders, or purse/bag straps.

Both the outer case 10 and the flap 12 may be formed from a plastic, such as vinyl, or other appropriate flexible material, such as leather. In certain embodiments, the hook and loop fastener portions may be provided as industrial strength, which ensures the flap 12 is securely retained to a user's body (such as on a belt 26, as depicted in FIG. 1). At one or more bottom portions of the outer case 10, drain slots 15 are defined to evacuate water or debris. The case 10 may be stitched (using high-strength thread, such as nylon ripcord or KEVLAR®, which is 2.5 times stronger than 3-ply nylon ripcord), not glued, to couple various components together. However, it will be appreciated that industrial glue may also be appropriate.

Figure 3:
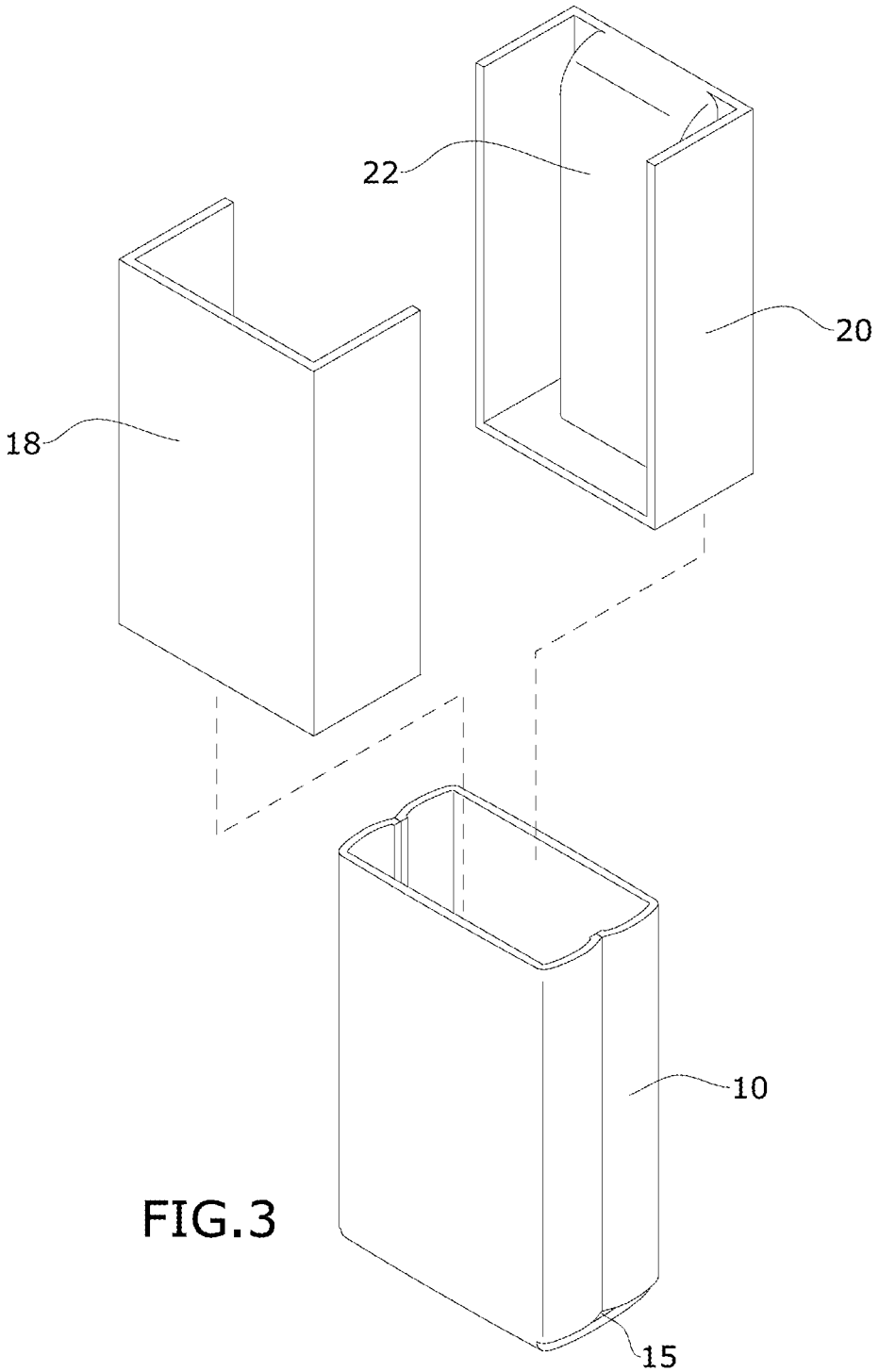
FIG. 3 is an exploded view of the embodiment of the present invention.
Figure 4:
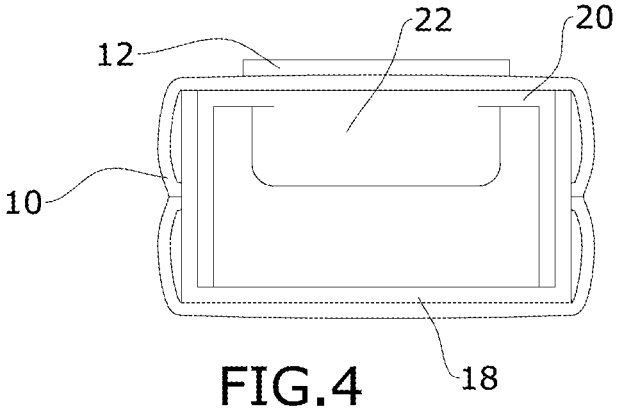
FIG. 4 is a top view of the embodiment of the present invention.

Referring to FIG. 3, the rigid removable inserts 18, 20 are generally comprised of a first insert 18 and a second insert 20 (it will be appreciated that "first" and "second" are used only to delineate between the respective inserts in this specification) that are configured to fit tightly in the outer case 10. As shown, for example, in FIGS. 4-6, the first insert 18 and the second insert 20 have complementarily designed sidewalls and bottom walls such that, in use, they nest with one another to form a protective shell around the glasses 24. Because the inserts 18, 20 are independent parts and movable relative to one another, they can automatically adjust (e.g., slide away from one another) to differently sized glasses 24. As shown in FIG. 4, the nesting feature, by design, creates a "stop" to space the outer walls of the inserts 18, 20 a minimum predetermined distance from one another. Thus, glasses 24 are protected from crushing if the eyeglass case is compressed, even with significant force.

In certain embodiments, the inserts 18, 20 may be formed from a hard plastic material. The inserts 18, 20 may be formed by various appropriate processes, such as injection molding. They may further be provided with a microfiber lining to prevent scratches to the lenses of the glasses 24.

Referring to FIGS. 3-6, the locking pad 22 is coupled to or integral with the second insert 20. In certain embodiments, the pad 22 may be formed from a foam material, such as memory foam. The pad 22, as shown in FIG. 5, deforms to the shape of and presses against a portion of the glasses 24 to hold them securely in place, but can release easily for the glasses 24 to be extracted when needed. Thus, the combination of the locking pad 22, movable inserts 18, 20, and flexible outer case 10 enable embodiments of the present invention to effectively retain glasses 24 without the need of an external cover (which would typically be needed to ensure glasses 24 do not fall out of the case).

In typical use of the present invention, the first insert 18 and the second insert 20 are positioned in the outer case 10 such that the second insert 20 nests within the first insert 18 (or vice versa, if slightly reconfigured). Glasses 24 are inserted in the open mouth end of the outer case 10, deforming the locking pad 22 as it is slid into the eyeglass case. Depending on the size and/or shape of the glasses 24, the inserts 18, 20 can auto-adjust relative to one another to compensate for differently designed glasses 24, with the microfiber lining protecting the glasses 24 from scratches.

As shown in FIGS. 1 and 5, the eyeglass case can be configured such that an end portion of the glasses 24 partially protrudes from the open mouth end. This leaves very little of the glasses 24 exposed to damage while enabling easy single-handed insertion and extraction of the glasses 24. In other embodiments, the glasses 24 may be fully inserted into the eyeglass case (such that they do not protrude therefrom), while the open mouth end still provides easy access for single-handed insertion and removal.

Figure 9:
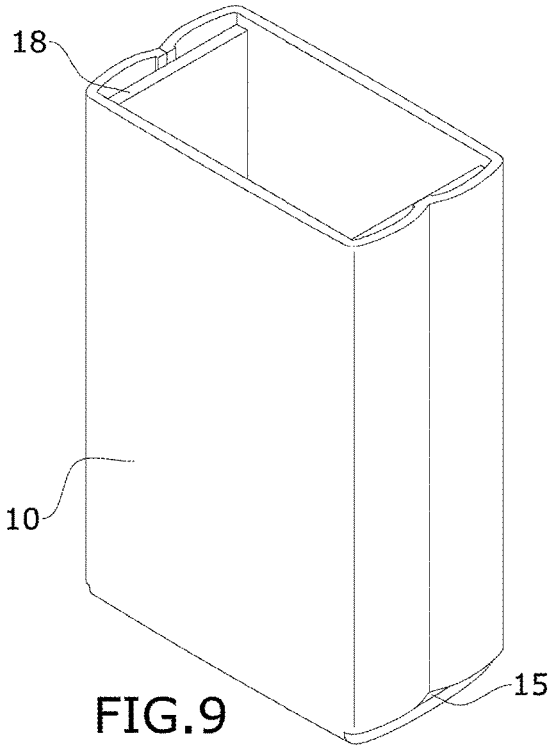
FIG. 9 is a front perspective view of the embodiment of the present invention, shown in an alternate arrangement.
Figure 10:
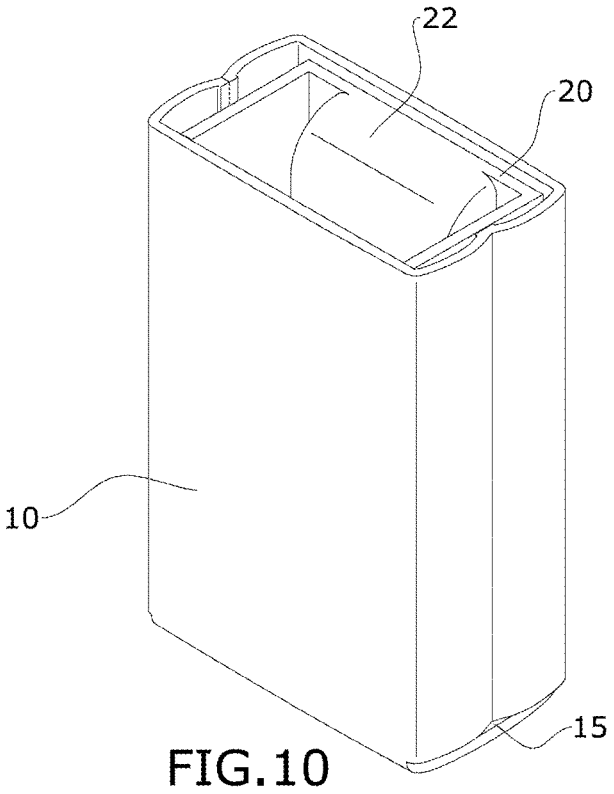
FIG. 10 is a front perspective view of the embodiment of the present invention, shown in another alternate arrangement.
Figure 11:
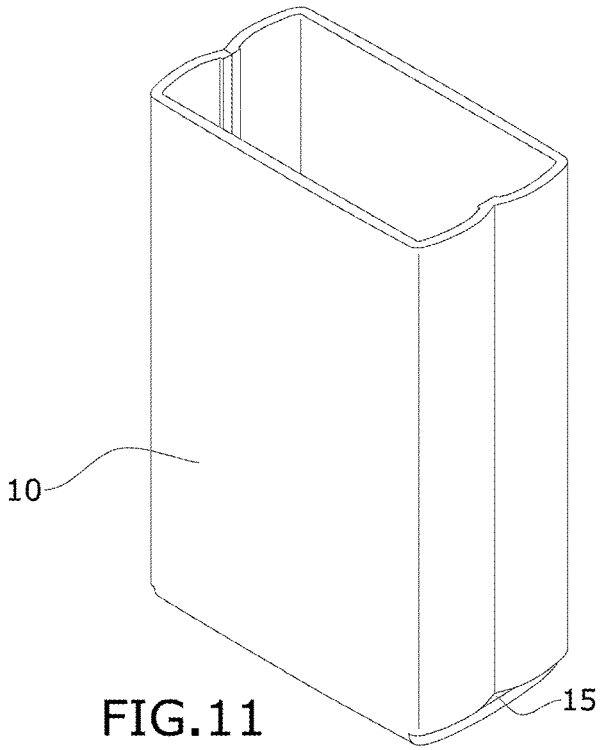
FIG. 11 is a front perspective view of the embodiment of the present invention, shown in yet another alternate arrangement.

FIGS. 9-11 illustrate other usable configurations of the present invention enabled by the unique design. While the previously described "typical use" configuration enables the most secure protection for glasses, it will be appreciated that the components may be selectively used to offer more varied configurations.

For example, as shown in FIG. 9, only the first insert 18 may be inserted into the outer case 10, providing impact protection from an outer side and flexibly supporting the glasses 24 on the opposite side.

As shown in FIG. 10, the second insert 20 with locking pad 22 may be inserted into the outer case 10 (with the first insert 20 omitted), which provides the cushioned support previously described and ensures the glasses 24 cannot slip, undesired, from the eyeglass case.

Finally, as shown in FIG. 11, both inserts 18, 20 may be entirely removed from the outer case 10, with the outer case 10 functioning as a stand-alone case. This configuration is particularly advantageous for large and/or deeply curved glasses 24.

The value of the present invention is readily apparent. As mentioned, eyewear today can cost hundreds, even thousands, of dollars. Many types of glasses, such as reading glasses or sunglasses, are taken off and put on numerous times in a day. Handy, secure storage for these part-time ocular devices always presents a problem. The eyewear case disclosed herein solves that problem handily and permanently. Some people wear their reading glasses on a string around their neck, some on the top of their head, and others in the crotch of the open neck of a polo shirt. Sunglasses and reading glasses are often relegated to pockets where they are scratched, bent, broken, or simply fall out. Some people just forget where they put them. When hung from a shirt or sweater or worn on the top of the head, they are often simply lost. If an individual takes off their sunglasses on a boat, they are very likely to be lost. The same is true for horseback or bike riding. Any kind of eyewear tends to suffer damage or loss by an active person. The more vigorous the activity, the heavier and more frequently eyewear damage or loss occurs.

This case solves those problems. The expensive glasses will not be ejected from the case, and the case will not be dislodged from the belt. The glasses will not be bent, squashed, flattened, scratched, or broken. The individual can be secure in the knowledge that if an outdoor activity becomes too vigorous and goes totally wrong, while they may be injured, their eyeglasses, safe and ensconced snugly in the case, will not be.

Further, as those with skill in the art will appreciate, it could function for other uses. For example, if the case were stretched to be a little shallower internally and a bit wider, it could operate as a cell phone case. If notched to allow a trigger guard on one side, it could be a pistol holster that is flat and highly concealable.

As described above, various manufacturing techniques and materials may be employed to form the present invention, such that the appropriate strength and retention ability is achieved. For example, any semi-soft vinyl (or leather) outer case 10 may be cut into a rectangle shape dimensioned, for example, 5 inches by 2.75 inches. The belt mounting flap 12 (which may be, for example, 2 inches by 4.75 inches) may be cut from the same material and may be stitched on. Hook and loop fasteners 14, 16 (which may be, for example, 2-inch by 2-inch squares) can be glued or stitched onto the case 10 and flap 12 by machine or hand and the memory foam locking pad 22 (which may be, for example, 2 inches by ⅛ inch) glued with epoxy or stitched to an insert 20. The microfiber lining is glued to the inside of the case 10, and the rigid plastic inserts 18, 20 may be hard injection molded high impact polystyrene plastic cut to size and shape by standard machines for injection molded plastics.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

While apparatuses and methods are described in terms of "comprising," "containing," or "including" various components or steps, the apparatuses and methods can also "consist essentially of" or "consist of" the various components and steps. All numbers and ranges disclosed above may vary by some amount. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted. As used herein, terms such as "flexible" and "rigid" are intended to convey a level of hardness or flexibility relative to the other components (e.g., a rigid component is more rigid in form than a flexible component). Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An eyeglass case for eyeglasses comprising:

a flexible outer case defining a substantially closed end and an open end;

a first rigid insert shaped to removably fit within the flexible outer case;

a second rigid insert shaped to removably nest with the first rigid insert in a nested condition, wherein each rigid insert comprises an outer wall; and a pair of sidewalls, wherein proximal longitudinal edges of the pair of sidewalls are joined respective opposing longitudinal edges of the outer wall in an orthogonal direction thereto, wherein distal longitudinal edges of the pair of sidewalls are unconnected to each other, wherein in the nested condition at a stopped position thereof, the distal longitudinal edges of each pair of sidewalls abuts the outer wall of the other rigid insert, whereby the respective outer walls are prevented in the stopped position from moving in the orthogonal direction toward each other, wherein the nested condition the rigid inserts define an open mouth for receiving the eyeglass therethrough, and wherein the open mouth provides a void having orthogonal boundaries defined by the outer walls of said rigid insert, wherein void is uninterrupted in the orthogonal direction between said orthogonal boundaries;

and a locking pad coupled to an interior surface of the outer wall of the second rigid insert, the locking pad being configured to deform when the eyeglasses are inserted through the open mouth so that the outer walls of said rigid inserts move in the orthogonal direction away from each other in the nested condition without a compressive force pushing the rigid inserts in the orthogonal direction toward each other, thereby facilitating an automatic adjustability in response to a size of the inserted eyeglasses.

2. The eyeglass case of claim 1, further comprising a flap coupled to the flexible outer case for securing the flexible outer case to a belt or a strap.

3. The eyeglass case of claim 2, wherein one end of the flap comprises a loop fastener portion, and the flexible outer case comprises a hook fastener portion for selective coupling with the loop fastener portion.

4. The eyeglass case of claim 1, wherein the substantially closed end of the flexible outer case defines one or more drain slots.

5. The eyeglass case of claim 1, wherein the flexible outer case is formed from a vinyl plastic or a leather material, the first rigid insert is formed from a polystyrene plastic material, and the locking pad is formed from a memory foam material.

6. The eyeglass case of claim 1, wherein the nested condition further defines the open end.

7. The eyeglass case of claim 1, wherein each rigid insert defines a U-shape.

8. The eyeglass case of claim 1, wherein the locking pad diametrically opposes the outer wall of the second rigid insert.

* * * * *